US010984760B2

(12) United States Patent
Abe et al.

(10) Patent No.: US 10,984,760 B2
(45) Date of Patent: Apr. 20, 2021

(54) MUSICAL INSTRUMENT AND VIBRATOR

(71) Applicant: YAMAHA CORPORATION, Hamamatsu (JP)

(72) Inventors: Banri Abe, Hamamatsu (JP); Masatsugu Okazaki, Hamamatsu (JP); Ichiro Osuga, Hamamatsu (JP); Shinji Sumino, Hamamatsu (JP); Takuya Abe, Kakegawa (JP); Takashi Kitagawa, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/790,895

(22) Filed: Feb. 14, 2020

(65) Prior Publication Data

US 2020/0184935 A1 Jun. 11, 2020

Related U.S. Application Data

(63) Continuation of application No. PCT/JP2018/021398, filed on Jun. 4, 2018.

(30) Foreign Application Priority Data

Aug. 25, 2017 (JP) ..... JP2017-162688

(51) Int. Cl.
*G10C 3/06* (2006.01)
*G10C 1/00* (2006.01)
(Continued)

(52) U.S. Cl.
CPC ..... *G10C 3/06* (2013.01); *G10C 1/00* (2013.01); *G10H 1/32* (2013.01); *G10H 3/22* (2013.01)

(58) Field of Classification Search
CPC ... G10C 3/06; G10C 1/00; G10C 1/32; G10H 3/22
See application file for complete search history.

(56) References Cited

U.S. PATENT DOCUMENTS 2,529,862 A * 11/1950 Bilhuber ..... G10C 9/00 34/255
6,965,679 B1 * 11/2005 Lopez Bosio ..... H04R 1/028 381/152

(Continued)

FOREIGN PATENT DOCUMENTS

JP 2008298992 A 12/2008
JP 2009175146 A 8/2009
JP 2015114458 A 6/2015

OTHER PUBLICATIONS

English translation of Written Opinion issued in Intl. Appln. No. PCT/JP2018/021398 dated Aug. 7, 2018, previously cited in IDS filed Feb. 14, 2020.

(Continued)

*Primary Examiner* — Robert W Horn
(74) *Attorney, Agent, or Firm* — Rossi, Kimms & McDowell LLP

(57) ABSTRACT

Provided is a musical instrument including a vibratable body; and a vibrator. The vibrator includes a vibrating body that vibrates in a predetermined direction; and a coupling member coupling the vibrating body and the vibratable body and that transmits vibration of the vibrating body to the vibratable body. The coupling member includes a shaft extending between the vibrating body and the vibratable body; a first wire rod coupling one end portion of the shaft and the vibrating body; and a second wire rod coupling another end portion of the shaft and the vibratable body. A (Continued)

resonance frequency of each of the shaft, the first wire rod, and the second wire rod is at least 10 kHz.

16 Claims, 11 Drawing Sheets

(51) Int. Cl.
*G10H 1/32* (2006.01)
*G10H 3/22* (2006.01)

(56) References Cited

U.S. PATENT DOCUMENTS 7,085,391 B1 * 8/2006 Yamaya ..... G10H 1/32 381/118
7,678,988 B2 * 3/2010 Sato ..... G10H 3/146 84/743
8,859,866 B2 * 10/2014 Onishi ..... G10C 3/04 84/174
8,962,966 B2 * 2/2015 Ohnishi ..... G10H 1/045 84/719
9,035,164 B2 * 5/2015 Ohnishi ..... G10H 1/32 84/744
9,240,171 B1 * 1/2016 Satoh ..... G10H 3/22
9,269,335 B2 * 2/2016 Ohnishi ..... G10H 1/32
9,373,314 B2 * 6/2016 Takahashi ..... H04R 9/02
9,508,324 B2 * 11/2016 Ohnishi ..... G10H 1/32
9,532,124 B2 * 12/2016 Satomi ..... G10H 3/22
9,591,400 B2 * 3/2017 Ohnishi ..... H04R 1/46
9,779,711 B2 * 10/2017 Ohnishi ..... G10C 3/06
9,959,843 B2 * 5/2018 Ohnishi ..... G10C 3/166
10,304,435 B2 * 5/2019 Ekuni ..... G10D 1/08
10,891,923 B2 * 1/2021 Okazaki ..... G10H 3/22
2005/0180587 A1 * 8/2005 Lopez Bosio ..... H04R 7/04 381/150
2009/0038469 A1 * 2/2009 Suzuki ..... G10H 3/26 84/744
2013/0061734 A1 * 3/2013 Koseki ..... G10H 1/0091 84/189
2020/0184935 A1 * 6/2020 Abe ..... G10H 1/32

OTHER PUBLICATIONS

International Preliminary Report on Patentability issued in Intl. Appln. No. PCT/JP2018/021398 dated Mar. 5, 2020. English translation provided.
International Search Report issued in Intl. Appln. No. PCT/JP2018/021398 dated Aug. 7, 2018. English translation provided.
Written Opinion issued in Intl. Appln. No. PCT/JP2018/021398 dated Aug. 7, 2018.

* cited by examiner

MUSICAL INSTRUMENT AND VIBRATOR

CROSS-REFERENCE TO RELATED APPLICATION

The present application is continuation of International Application No. PCT/JP2018/021398, filed on Jun. 4, 2018, which claims priority from Japanese Application No. JP 2017-162688 filed on Aug. 25, 2017. The contents of these applications are hereby incorporated by reference into this application.

BACKGROUND OF THE INVENTION

1. Field of the Invention

The present invention relates to a musical instrument, and more particularly, to a musical instrument including a vibrator configured to generate a sound by operating based on an audio signal to vibrate a vibrated body.

2. Description of the Related Art

Hitherto, there is known a keyboard musical instrument or another such device configured to generate a sound from a vibrated body by operating a vibrator based on an audio signal to vibrate a soundboard or another such vibrated body (see, for example, Japanese Patent Application Laid-open No. 2008-298992). This type of vibrator includes a magnetic path forming portion configured to form a magnetic path, a vibrating body provided so as to protrude from the magnetic path forming portion, and a coupling member configured to couple the vibrating body and the vibrated body to each other. The vibrating body is vibrated relative to the magnetic path forming portion based on the audio signal, and the vibration of the vibrating body is transmitted to the vibrated body through the coupling member, to thereby convert the vibration of the vibrated body into a sound.

However, dimensional change and deformation may be caused in the vibrated body by aged deterioration due to the influences of temperature and humidity, or resonance may be caused in the coupling member connecting the vibrating body and the vibrated body to each other. In this case, there may occur problems of a failure in appropriately vibrating the vibrated body, noise mixed into the sound, and the like.

SUMMARY OF THE INVENTION

The present invention has been made in view of the above-mentioned circumstances, and has an object to provide a musical instrument capable of appropriately generating a sound by appropriately vibrating a vibrated body while suppressing resonance of a coupling member of a vibrator.

In order to solve the above-mentioned problem, a musical instrument according to one aspect of the present disclosure includes a vibratable body; and a vibrator. The vibrator includes a vibrating body that vibrates in a predetermined direction; and a coupling member coupling the vibrating body and the vibratable body and that transmits vibration of the vibrating body to the vibratable body. The coupling member includes a shaft extending between the vibrating body and the vibratable body; a first wire rod coupling one end portion of the shaft and the vibrating body; and a second wire rod coupling another end portion of the shaft and the vibratable body. A resonance frequency of each of the shaft, the first wire rod, and the second wire rod is at least 10 kHz.

Further, in order to solve the above-mentioned problem, a musical instrument according to one aspect of the present disclosure includes a vibratable body; and a vibrator. The vibrator includes a vibrating body provided so as to vibrate in the predetermined direction; and a coupling member coupling the vibrating body and the vibratable body, and that transmits vibration of the vibrating body to the vibratable body. The coupling member includes: a shaft extending between the vibrating body and the vibratable body; a first wire rod coupling one end portion of the shaft and the vibrating body; and a second wire rod coupling another end portion of the shaft and the vibratable body. Each of the first wire rod and the second wire rod is made of a steel wire including a carbon content of 0.60% to 1.00%. The shaft is made of a metal material with a higher specific rigidity than specific rigidities of the first wire rod and the second wire rod.

Further, in order to solve the above-mentioned problem, a vibrator for a musical instrument according to one aspect of the present disclosure includes a vibrating body that vibrates in a predetermined direction; and a coupling member coupling the vibrating body and configured to be coupled to the vibratable body to transmit vibration of the vibrating body to the vibratable body. The coupling member includes: a shaft configured to extend between the vibrating body and the vibratable body; a first wire rod coupling one end portion of the shaft and the vibrating body; and a second wire rod coupled to another end portion of the shaft and configured to be coupled to the vibratable body. A resonance frequency of each of the shaft, the first wire rod, and the second wire rod is at least 10 kHz.

According to the present disclosure, with the musical instrument including the vibrator configured to generate the sound by operating based on the audio signal to vibrate the vibrated body, it is possible to appropriately generate the sound by appropriately vibrating the vibrated body while suppressing resonance of the coupling member of the vibrator.

DETAILED DESCRIPTION OF THE INVENTION

At least one embodiment of the present invention is described below with reference to the accompanying drawings. In at least one embodiment of the present invention, a piano being one of keyboard musical instruments is illustrated as an example of a musical instrument including a vibrator configured to generate a sound by operating based on an audio signal to vibrate a vibrated body. As an example of the vibrated body, a soundboard is illustrated. However, the musical instrument according to at least one embodiment of the present invention is not limited to those examples, and may employ any configuration in which the vibrator is driven by a drive signal based on the audio signal, to thereby vibrate the vibrated body to generate a sound.

Figure 1:
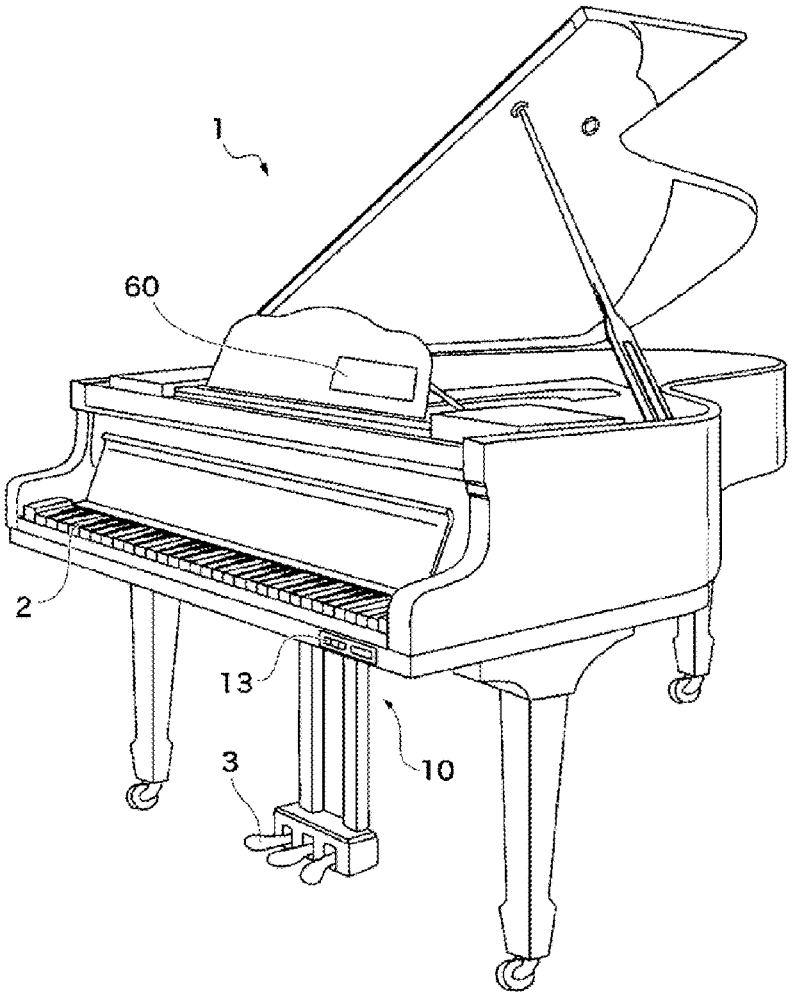
FIG. 1 is a perspective view for illustrating an outer appearance of a piano according to one embodiment of the present disclosure.

FIG. 1 is a perspective view for illustrating an outer appearance of a piano 1 according to one embodiment. The piano 1 includes, on its front surface, a keyboard on which a plurality of keys 2 are arranged and pedals 3. A player (user) uses the keyboard to perform a musical performance operation. The piano 1 also includes, on its front surface, a control device 10 including an operation panel 13 and a touch panel 60 provided to a music stand. The user is allowed to input an instruction to the control device 10 by operating the operation panel 13 and the touch panel 60.

Figure 2:
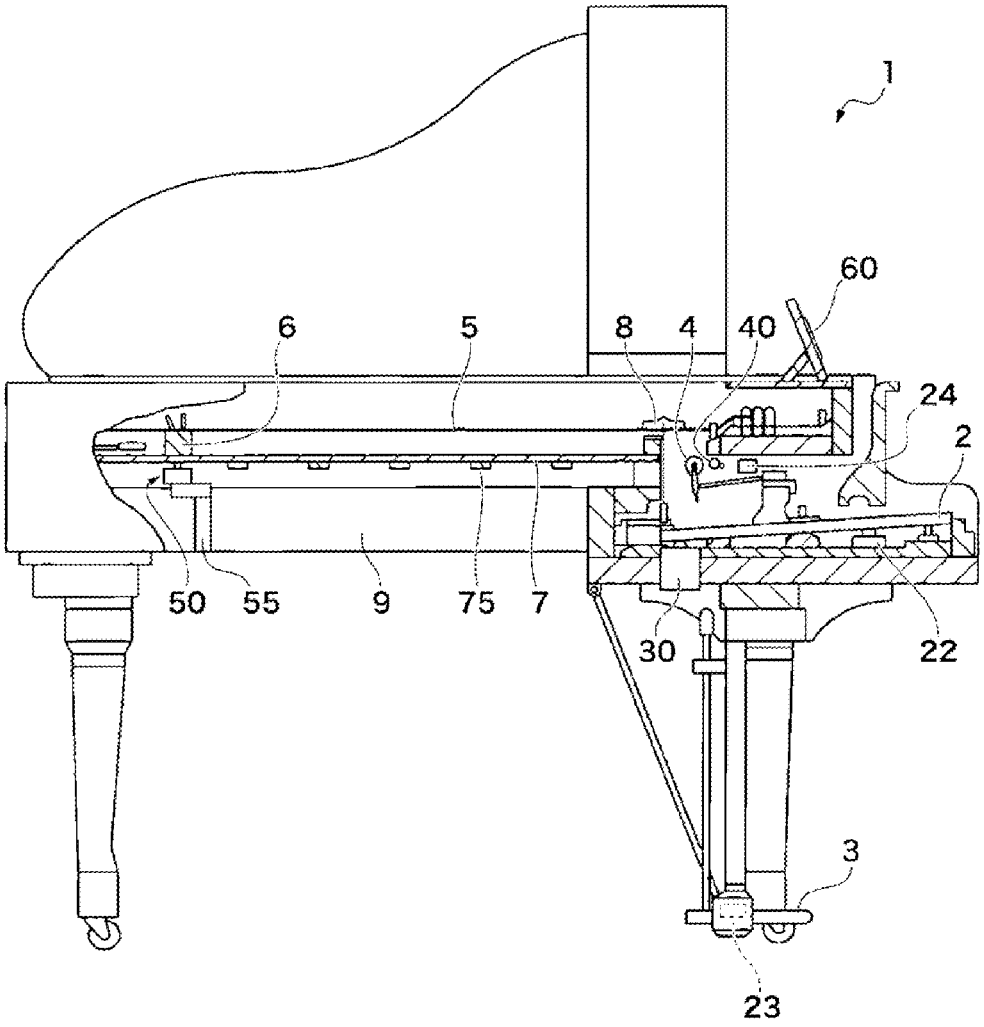
FIG. 2 is a cross-sectional view for illustrating an internal structure of the piano according to the one embodiment.

FIG. 2 is a cross-sectional view for illustrating an internal structure of the piano 1. In FIG. 2, a structure and a configuration provided in correspondence to each key 2 are illustrated by focusing on one of the keys 2. The description of portions provided in correspondence to another key 2 is omitted. A key driver 30 configured to drive the key 2 through use of a solenoid is provided at a lower part on the rear end side of each key 2 (deep side of the key 2 when viewed from the user performing the musical performance).

The key driver 30 drives the corresponding solenoid based on a control signal output from the control device 10, which is illustrated in FIG. 1, to raise a plunger, to thereby reproduce the same state as when the user pressed the key, and meanwhile to lower the plunger, to thereby reproduce the same state as when the user releases the key.

A string 5 and a hammer 4 are provided in correspondence to each key 2. When the key 2 is pressed, the hammer 4 is pivoted through the intermediation of an action mechanism (not shown) to strike the string 5 corresponding to each key 2. A damper 8 is displaced based on the depression amount of the key 2 and the depression amount of a damper pedal among the pedals 3, and is brought into non-contact or contact with the string 5. A stopper 40 operates when a string striking inhibition mode is set in the control device 10, and receives a strike from below each hammer 4 to inhibit the hammer 4 from striking the string 5.

A key sensor 22 is provided below each key 2 in correspondence to each key 2, and outputs a detection signal corresponding to the behavior of the corresponding key 2 to the control device 10. A hammer sensor 24 is provided in correspondence to the hammer 4, and outputs a detection signal corresponding to the behavior of the corresponding hammer 4 to the control device 10. A pedal sensor 23 is provided in correspondence to each pedal 3, and outputs a detection signal corresponding to the behavior of the corresponding pedal 3 to the control device 10.

Although not shown, the control device 10 includes a CPU, a ROM, a RAM, and a communication interface. Each kind of control to be performed by the control device 10 is implemented by the CPU executing a control program stored in the ROM.

A soundboard 7 is a plate-like member formed of wood. On the soundboard 7, soundboard ribs 75 and a bridge 6 are arranged. Part of the stretched strings 5 are engaged with the bridge 6. Therefore, the vibration of the soundboard 7 is transmitted to each string 5 through the bridge 6, and the vibration of each string 5 is transmitted to the soundboard 7 through the bridge 6.

The vibrator 50 has one end (lower end) fixedly supported by a support portion 55 connected to a brace 9, and has the other end (upper end) fixedly connected to the soundboard 7. The support portion 55 is formed of an aluminum material or other such metal. The brace 9 is a member configured to support the tension of the strings 5 together with a frame, and is a part of the structure of the piano 1. The vibrator 50 has a function of vibrating the soundboard 7 in a predetermined direction, to thereby generate a sound from the vibration of the soundboard 7.

Figure 3:
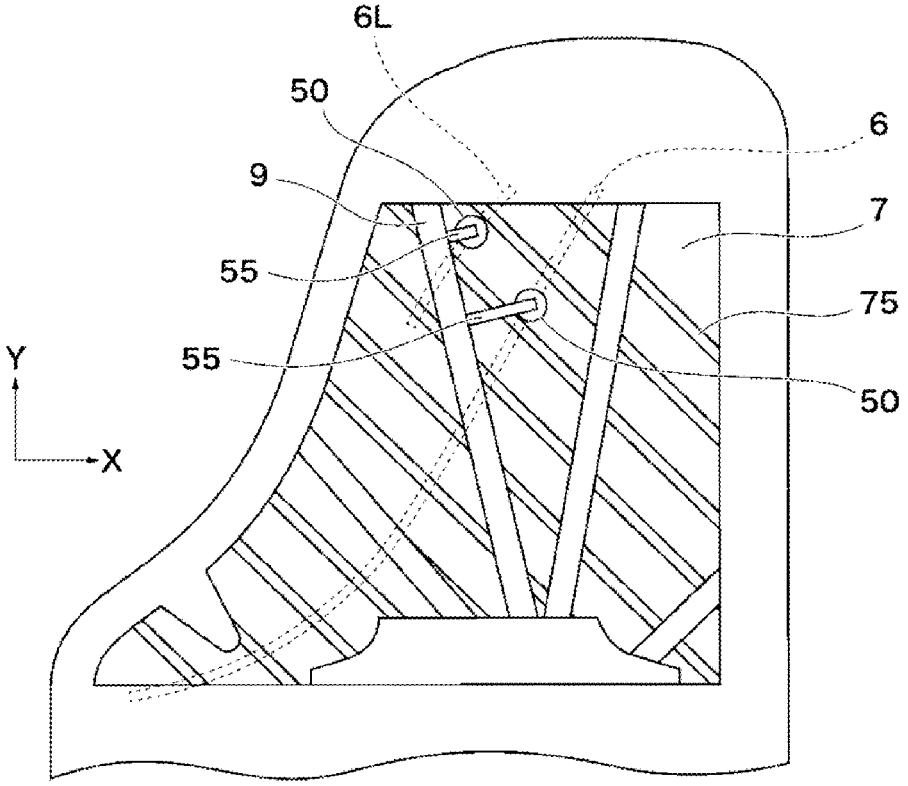
FIG. 3 is a rear view of a soundboard for illustrating a mounting position of each vibrator according to the one embodiment.

Next, a specific structure and a specific configuration of the vibrator 50 are described. FIG. 3 is a rear view of the soundboard 7 for illustrating a mounting position of each vibrator 50. The vibrator 50 is an electrodynamic vibrator, but, for example, an electrostatic speaker or a piezo speaker may be used.

The vibrator 50 is connected to the soundboard 7 so as to be arranged between a plurality of soundboard ribs 75 arranged on the soundboard 7. In FIG. 3, two vibrators 50 having the same structure and configuration are connected to the soundboard 7, but the number of vibrators 50 may be one or at least three. It is preferred that the vibrator 50 be arranged at a position as close as possible to the bridge 6. In at least one embodiment, the vibrator 50 is arranged on the opposite side of the bridge 6 across the soundboard 7. In the following description, it is assumed that, when viewed from the player of the piano 1, the left-right direction is the X-axis direction, the front-rear direction is the Y-axis direction, and the up-down direction is the Z-axis direction (predetermined direction). The X-Y direction is the horizontal direction.

Figure 4:
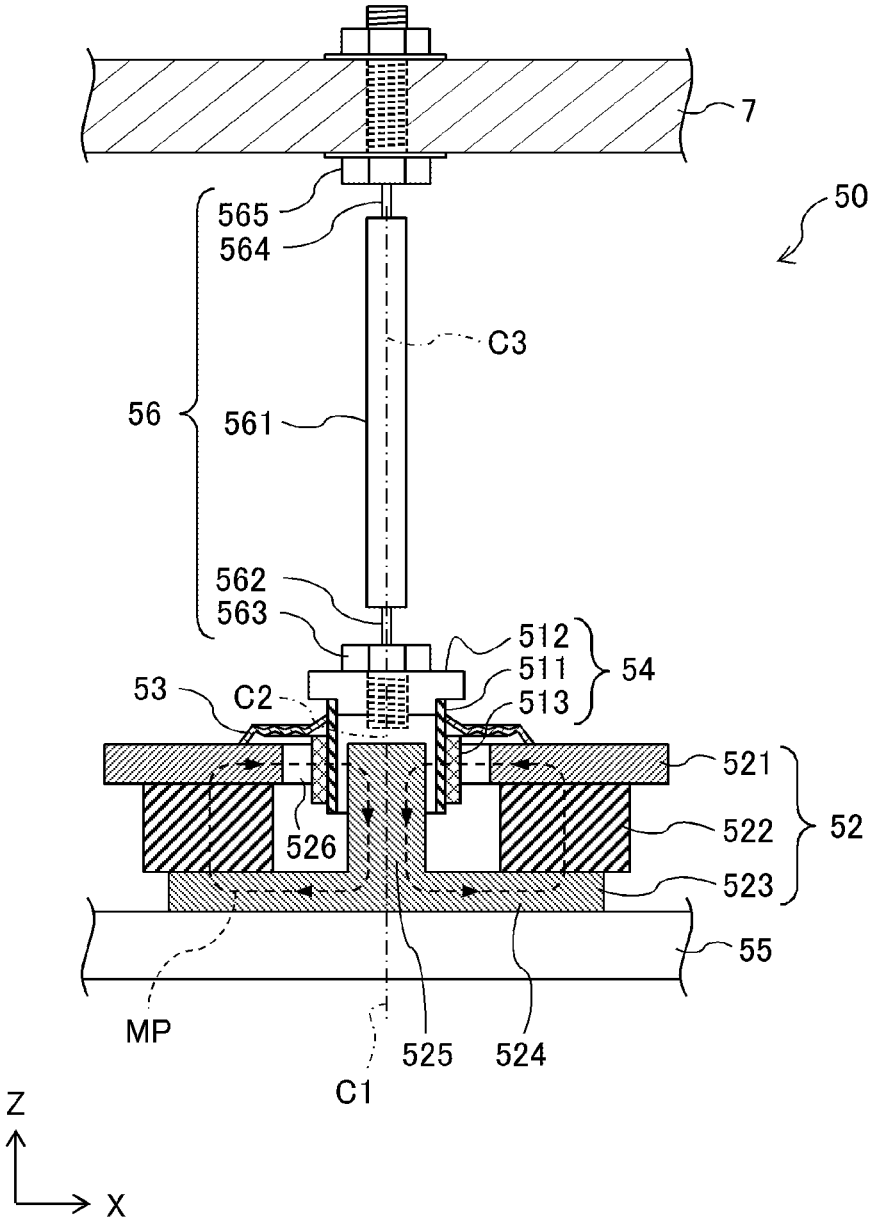
FIG. 4 is a longitudinal cross-sectional view of the vibrator according to the one embodiment.

FIG. 4 is a longitudinal cross-sectional view of the vibrator 50. The vibrator 50 is an actuator of a voice-coil type, and includes a magnetic path forming portion 52, a vibrating body 54, and a coupling member 56.

The magnetic path forming portion 52 includes a top plate 521, a magnet 522, and a yoke 523, and forms a magnetic path based on an audio signal.

The top plate 521 is made of, for example, a soft magnetic material including soft iron, and is formed in a disk-like shape having a through hole in its center.

The yoke 523 is made of, for example, a soft magnetic material including soft iron, and is formed by integrally forming a disk portion 524 having a disk shape and a columnar portion 525 having a columnar shape that protrudes upward from the center of the disk portion 524. The axes of the disk portion 524 and the columnar portion 525 match each other. The outer diameter dimension of the columnar portion 525 is set smaller than the inner diameter dimension of the through hole of the top plate 521.

The magnet 522 is a permanent magnet formed in an annular shape. The inner diameter dimension of the magnet 522 is set larger than the inner diameter dimension of the through hole of the top plate 521. The magnet 522 is fixed to the disk portion 524 of the yoke 523 after the columnar portion 525 of the yoke 523 is inserted through the magnet 522. In addition, the top plate 521 is fixed to the magnet 522 so as to sandwich the magnet 522 between the top plate 521 and the disk portion 524 of the yoke 523 and so as to insert the tip portion of the columnar portion 525 into the through hole of the top plate 521.

Under a state in which the top plate 521, the magnet 522, and the yoke 523 are thus fixed to one another, their axes match one another, and form an axis C1 of the magnetic path forming portion 52.

In the magnetic path forming portion 52 in at least one embodiment configured as described above, a magnetic path MP is formed. The magnetic path MP passes from the magnet 522 through the top plate 521, the columnar portion 525, and the disk portion 524 in the stated order to return to the magnet 522. This causes a magnetic field including a radial component of the columnar portion 525 to be generated between the inner peripheral surface of the top plate 521 and the outer peripheral surface of the columnar portion 525 of the yoke 523. That is, space between the inner peripheral surface of the through hole of the top plate 521 and the outer peripheral surface of the columnar portion 525 of the yoke 523 is a magnetic field space 526 in which the above-mentioned magnetic field is generated.

The vibrating body 54 is provided so as to vibrate in a predetermined direction (Z-axis direction) with respect to the magnetic path forming portion 52. The vibrating body 54 includes a bobbin 511, a voice coil 513, and a cap 512.

The bobbin 511 is formed in a cylindrical shape. The columnar portion 525 of the magnetic path forming portion 52 is inserted into the bobbin 511, and the bobbin 511 is inserted into the through hole of the top plate 521. The axis of the bobbin 511 forms an axis C2 of the vibrating body 54.

The voice coil 513 is a conductive wire wound around the bobbin 511 on one end portion side (lower end portion side in FIG. 4) in the axial direction of the outer peripheral surface of the bobbin 511.

The cap 512 is fixed to the bobbin 511 so as to close the opening of the bobbin 511 on the other end portion side (upper end portion side in FIG. 4) in the axial direction. In addition, a hole (screw hole) capable of receiving the coupling member 56 described later in the axial direction of the bobbin 511 is formed in the cap 512.

The vibrating body 54 is mounted to the magnetic path forming portion 52 by a damper 53 such that one end portion of the bobbin 511 around which the voice coil 513 is wound is located in the magnetic field space 526 of the magnetic path forming portion 52 and that the other end portion of the bobbin 511 protrudes upward from the magnetic path forming portion 52.

The damper 53 plays the role of supporting the vibrating body 54 so as to prevent the vibrating body 54 from being brought into contact with the magnetic path forming portion 52. The damper 53 also plays the role of supporting the vibrating body 54 with respect to the magnetic path forming portion 52 so as to allow the vibrating body 54 to be displaced in the axial direction of the magnetic path forming portion 52 while causing the axis C2 of the vibrating body 54 and the axis C1 of the magnetic path forming portion 52 to match each other. The damper 53 is formed in an annular shape. The damper 53 is formed in a bellows shape that undulates in its radial direction. The inner edge of the damper 53 is fixed to the other end side (upper end side) of the bobbin 511, and the outer edge of the damper 53 is fixed to the top plate 521. The damper 53 is formed of, for example, a fiber material or a resin material so as to have a bellows shape that undulates in the radial direction, and has a structure that is flexible and elastically deformable.

The coupling member 56, which is arranged between the vibrating body 54 and the soundboard 7, couples the vibrating body 54 and the soundboard 7 to each other, and transmits the vibration of the vibrating body 54 to the soundboard 7. The coupling member 56 includes a shaft portion 561 having a columnar shape and extending in the Z-axis direction between the vibrating body 54 and the soundboard 7, a first wire rod 562 and a first screw portion 563, which are configured to couple the lower end portion of the shaft portion 561 and the vibrating body 54 to each other, and a second wire rod 564 and a second screw portion 565, which are configured to couple the upper end portion of the shaft portion 561 and soundboard 7 to each other.

The lower end portion of the shaft portion 561 is fixed to the upper end portion of the first wire rod 562, and the lower end portion of the first wire rod 562 is fixed to the head of the first screw portion 563. The body portion of the first screw portion 563 is fixedly screwed into the screw hole formed in the cap 512 of the vibrating body 54. The upper end portion of the shaft portion 561 is fixed to the lower end portion of the second wire rod 564, and the upper end portion of the second wire rod 564 is fixed to the head of the second screw portion 565. The body portion of the second screw portion 565 passes through the soundboard 7 via a washer or a spring washer to be engaged with a nut, to thereby fixedly screw the second screw portion 565 into the soundboard 7. There are no particular limitations imposed on the method of fixing the first wire rod 562 to the shaft portion 561 and the first screw portion 563 and the method of fixing the second wire rod 564 to the shaft portion 561 and the second screw portion 565, and adhesive or welding is used for the fixing method. It is preferred to use welding for the fixing method from the viewpoint of weather resistance and long life. The shaft portion 561, the first wire rod 562, and the second wire rod 564 are provided so as to extend in the Z-axis direction (up-down direction). The position of the vibrating body 54 in the horizontal direction (X-Y direction) is determined by the damper 53 so that the axis C3 of the shaft portion 561, which is also the axial center of the coupling member 56, is aligned with the axis C1 of the magnetic path forming portion 52 and the axis C2 of the vibrating body 54.

The shaft portion 561 is made of a material having high specific rigidity, for example, a metal material including steel, iron, stainless steel, aluminum, titanium, or magnesium. In addition to the above-mentioned metal material, the shaft portion 561 may be made of a non-metal material including a polymer material, carbon fiber, glass fiber, or reinforced resin fiber, or may be made of a composite material of those materials. The first wire rod 562 and the second wire rod 564 are each made of a material having high specific strength, for example, a steel wire rod or other such metal material. In addition to the above-mentioned metal material, the first wire rod 562 and the second wire rod 564 may each be made of a non-metal material including a polymer material, carbon fiber, glass fiber, or reinforced resin fiber, or may each be made of a composite material of those materials. As the first wire rod 562 and the second wire rod 564, it is possible to use, for example, a piano wire being a steel wire (carbon steel metal wire) having a carbon content of from 0.60% to 1.00%. The first wire rod 562 and the second wire rod 564 each made of the above-mentioned material have a function as an absorption mechanism for absorbing a tilt with respect to the predetermined direction (Z-axis direction). For example, the first wire rod 562 and the second wire rod 564 are each structured so as to be lower in rigidity (higher in flexibility) than the shaft portion 561 and the damper 53.

A drive signal based on an audio signal is input from the control device 10 illustrated in FIG. 1 to the vibrator 50 having the above-mentioned structure and configuration. The control device 10 reads audio data corresponding to the audio signal stored in a storage unit (not shown). The control device 10 generates a drive signal for driving the vibrating body 54 based on the read audio data. When the soundboard 7 is vibrated based on a musical performance operation, the control device 10 detects the behaviors of the key 2, the pedal 3, and the hammer 4 by the key sensor 22, the pedal sensor 23, and the hammer sensor 24, respectively, to thereby detect the player's musical performance operation. The control device 10 generates musical performance information based on their detection results. The control device 10 generates an acoustic signal based on the generated musical performance information, performs edit, amplification, and other such processing on the generated acoustic signal, and outputs the processed signal to the vibrator 50 as a drive signal.

When a drive signal is input to the vibrator 50, the voice coil 513 receives a magnetic force in the magnetic field space 526, and the bobbin 511 receives a drive force in the Z-axis direction corresponding to a waveform indicated by the input drive signal. With this reception, the vibrating body 54 is excited by the magnetic path forming portion 52, which causes the vibrating body 54 to vibrate in the Z-axis direction. When the vibrating body 54 vibrates in the Z-axis direction, the vibration is transmitted to the soundboard 7 by the coupling member 56, and the soundboard 7 is vibrated. The vibration of the soundboard 7 is emitted into the air as a sound.

Incidentally, dimensional change and deformation may be caused in the soundboard 7 by aged deterioration due to the influences of temperature and humidity. When the dimensional change and deformation are caused in the soundboard 7, the axis C1 of the magnetic path forming portion 52, the axis C2 of the vibrating body 54, and the axis C3 of the coupling member 56 do not match one another. In this case, a positional relationship between the magnetic path forming portion 52 and the vibrating body 54 is inappropriate. Then, a malfunction occurs in the operation (vibration) of the vibrating body 54, and the vibration of the vibrating body 54 cannot be appropriately transmitted to the soundboard 7. Therefore, there is a fear that the soundboard 7 may fail to be appropriately vibrated.

Figure 5:
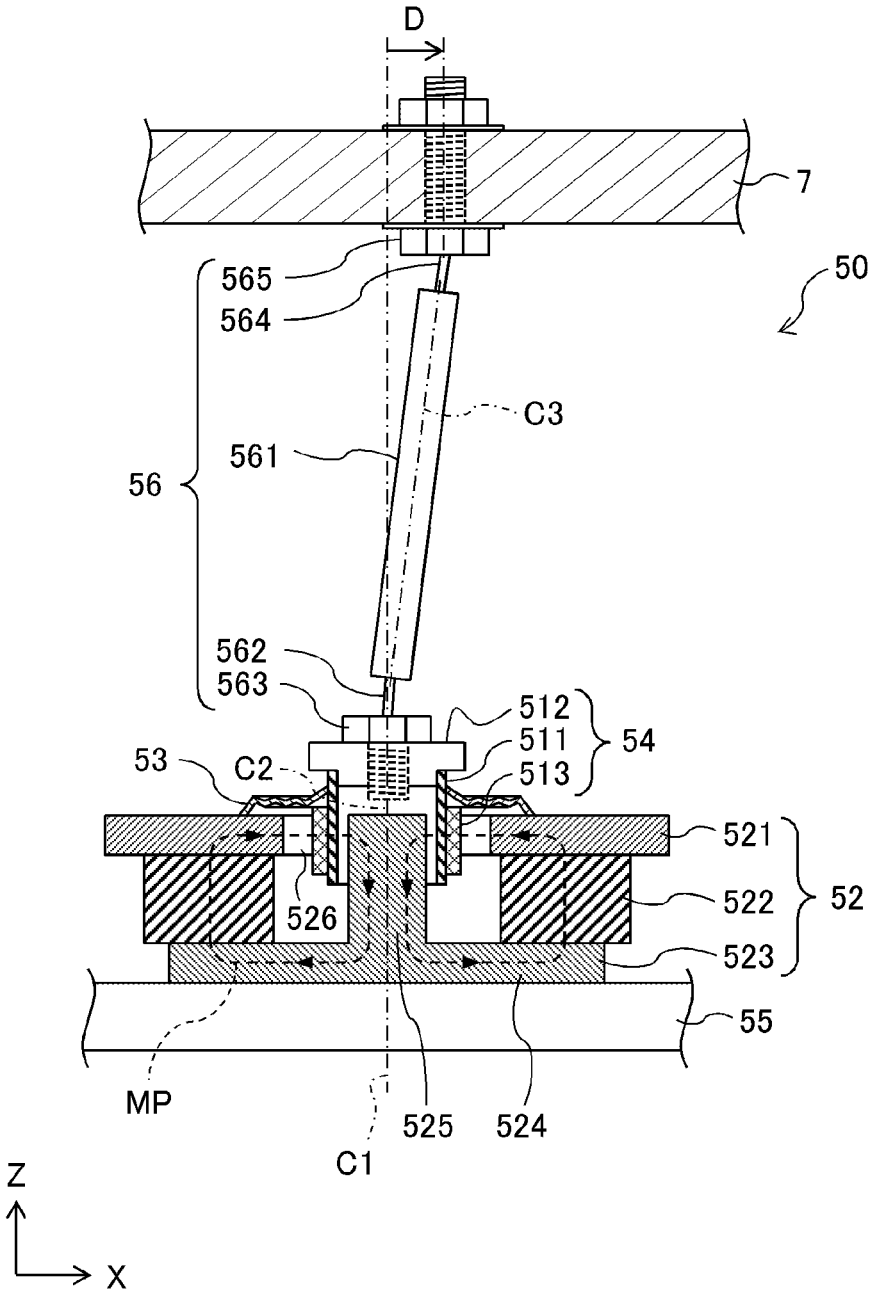
FIG. 5 is a longitudinal cross-sectional view for illustrating a state in which the soundboard is displaced in the vibrator according to the one embodiment.

In this respect, in at least one embodiment, the first wire rod 562 and the second wire rod 564 of the coupling member 56 function as the absorption mechanism. Therefore, for example, when a portion of the soundboard 7 to which the coupling member 56 is connected is displaced in a horizontal direction (for example, X-axis direction) within a predetermined range (for example, within a displacement amount D) as illustrated in FIG. 5, the first wire rod 562 and the second wire rod 564 are deformed (bent). With the deformation, a portion (second screw portion 565) connected to the soundboard 7 in the coupling member 56 is displaced in the horizontal direction relatively with respect to the brace 9, to thereby tilt the shaft portion 561 of the coupling member 56. In this manner, the displacement amount of the soundboard 7 is absorbed by the first wire rod 562 and the second wire rod 564, which prevents the vibrating body 54 from being horizontally displaced or tilted. Therefore, the vibrating body 54 is prevented from being horizontally displaced or tilted over a long period of time, and hence the relative position of a connecting portion (first screw portion 563) between the vibrating body 54 and the coupling member 56 with respect to the magnetic path forming portion 52 in the horizontal direction is maintained constant. The positional relationship between the magnetic path forming portion 52 and the vibrating body 54 is thus appropriately maintained, and hence the vibrating body 54 can be appropriately operated (vibrated), to thereby be able to appropriately transmit the vibration of the vibrating body 54 to the soundboard 7.

The coupling member 56 of one embodiment is also structured so as to have a resonance frequency higher than the maximum frequency of the audio signal (input signal). Specifically, for example, the coupling member 56 is structured so as to have a resonance frequency of at least 10 kHz, and more preferably, so as to have the resonance frequency having a high frequency outside an audible range (for example, a resonance frequency of at least 20 kHz). Specifically, the coupling member 56 is formed of a small and lightweight member. The shaft portion 561 is made of a material having higher specific rigidity than those of the first wire rod 562 and the second wire rod 564. The first wire rod 562 and the second wire rod 564 are each made of a material having moderate rigidity and high specific strength. The length of each of the shaft portion 561, the first wire rod 562, and the second wire rod 564 in the Z-axis direction is preferred to be short. For example, the length of the shaft portion 561 in the Z-axis direction is from 3 mm to 200 mm, and the length of each of the first wire rod 562 and the second wire rod 564 in the Z-axis direction is from 1 mm to 20 mm.

As described above, the vibrator 50 of one embodiment is preferred to have a resonance frequency higher than the maximum frequency of the audio signal (input signal). When the vibrator 50 is applied to, for example, a piano, the resonance frequency is preferred to be at least 10 kHz, and more preferably, at least 20 kHz from the viewpoint of being outside an audible range. With the vibrator 50 of one embodiment, the resonance of the coupling member 56 can be suppressed, and the soundboard 7 can be appropriately vibrated, which allows a sound to be appropriately emitted. In addition, with the vibrator 50 of one embodiment, the coupling member 56 can be reduced in weight. It is also possible to firmly connect the respective members forming the vibrator 50 to each other by, for example, adhesive, screws, or welding, to thereby be able to suppress unsteadiness. Therefore, it is possible to improve efficiency in transmitting the vibration to the soundboard 7.

With the vibrator 50 of one embodiment, it is also possible to reduce the number of parts of component members (in particular, coupling member 56). Therefore, it is possible to easily take measures against the resonance, and also to reduce the cost. In addition, the vibrating body 54 and the coupling member 56 can be reduced in weight, which can improve the characteristic (efficiency) of the high frequency.

The vibrator 50 of one embodiment further allows the dimensional change and deformation of the soundboard 7 to be absorbed by the first wire rod 562 and the second wire rod 564. This eliminates the requirement for repair and maintenance including the replacement of parts after the delivery.

The vibrator 50 of one embodiment of the present invention is not limited to the above-mentioned structure and configuration. For example, the coupling member 56 of the vibrator 50 may have the following structure and configuration.

Figure 6:
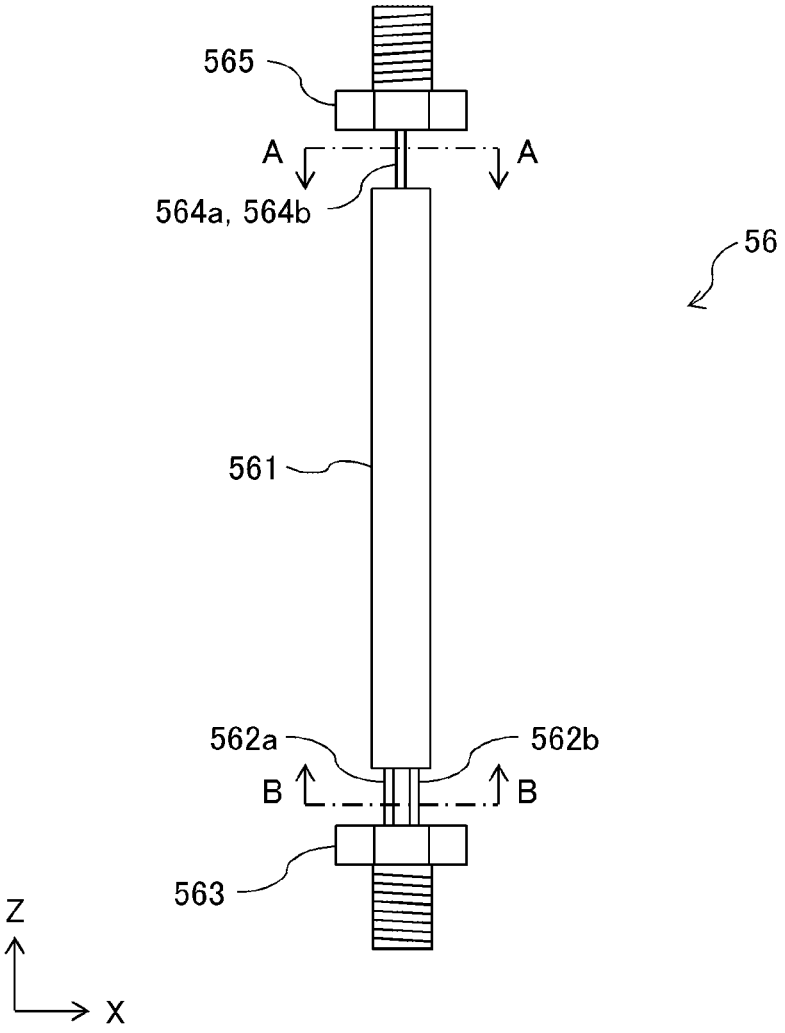
FIG. 6 is a side view for illustrating a coupling member in Modification Example 1 according to one embodiment of the present disclosure.
Figure 7A:
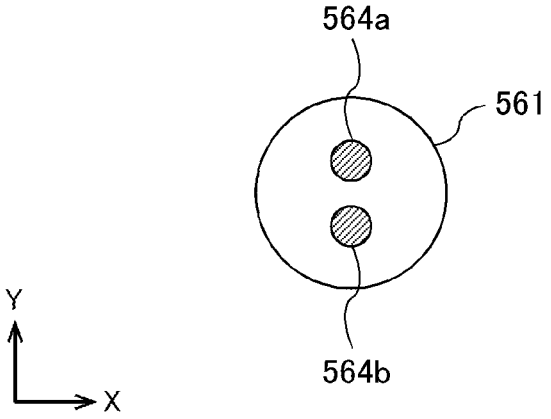
FIG. 7A is a cross-sectional view taken along the line A-A in FIG. 6.
Figure 7B:
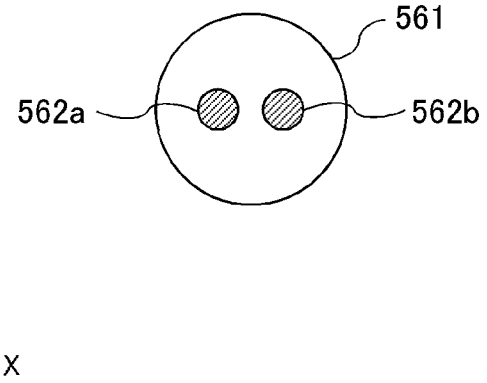
FIG. 7B is a cross-sectional view taken along the line B-B of FIG. 6.

FIG. 6 is a view for illustrating a structure of the coupling member 56 in Modification Example 1. FIG. 7A is a cross-sectional view taken along the line A-A in FIG. 6, and FIG. 7B is a cross-sectional view taken along the line B-B in FIG. 6. The coupling member 56 in Modification Example 1 includes the shaft portion 561 having a columnar shape, two first wire rods 562*a* and 562*b* illustrated in FIG. 6 and FIG. 7B, the first screw portion 563, two second wire rods 564*a* and 564*b* illustrated in FIG. 6 and FIG. 7A, and the second screw portion 565. The first wire rods 562*a* and 562*b* are arranged side by side in the X-axis direction so as to extend in the Z-axis direction in parallel with each other. The second wire rods 564*a* and 564*b* are arranged side by side in the Y-axis direction so as to extend in the Z-axis direction in parallel with each other. The arrangement direction (X-axis direction) of the first wire rods 562*a* and 562*b* and the arrangement direction (Y-axis direction) of the second wire rods 564*a* and 564*b* are perpendicular to each other. With the above-mentioned structure and configuration, the torsional vibration of the shaft portion 561 can be suppressed. It is also possible to seta frequency due to the torsional vibration to a high frequency, for example, to at least 10 kHz, and more preferably, to a high frequency outside the audible range.

Figure 8:
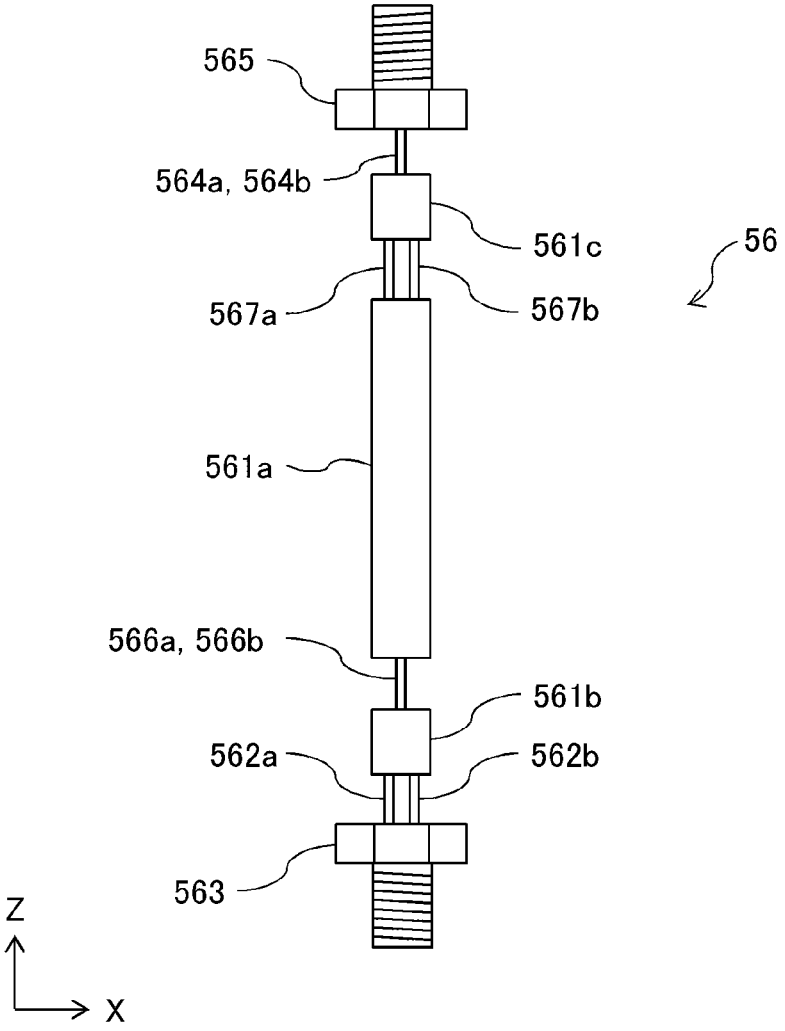
FIG. 8 is a side view for illustrating a coupling member in Modification Example 2 according to one embodiment of the present disclosure.

FIG. 8 is a side view for illustrating the coupling member 56 in Modification Example 2. The coupling member 56 in Modification Example 2 includes shaft portions 561*a*, 561*b*, and 561*c*, the two first wire rods 562*a* and 562*b*, the first screw portion 563, the two second wire rods 564*a* and 564*b*, the second screw portion 565, two third wire rods 566*a* and 566*b*, and two fourth wire rods 567*a* and 567*b*. The shaft portions 561*a*, 561*b*, and 561*c*, each of which has a columnar shape, are obtained by dividing a shaft portion into a plurality of portions so as to be arranged side by side in a predetermined direction (Z-axis direction). The first wire rods 562*a* and 562*b* are arranged side by side in the X-axis direction so as to extend in the Z-axis direction in parallel with each other. The second wire rods 564*a* and 564*b* are arranged side by side in the Y-axis direction so as to extend in the Z-axis direction in parallel with each other. The third wire rods 566*a* and 566*b* are arranged side by side in the Y-axis direction so as to extend in the Z-axis direction in parallel with each other. The fourth wire rods 567*a* and 567*b* are arranged side by side in the X-axis direction so as to extend in the Z-axis direction in parallel with each other. The cross-sectional shapes of the first wire rods 562*a* and 562*b* and the fourth wire rods 567*a* and 567*b* are the same as the cross-sectional shape illustrated in FIG. 7B. The cross-sectional shapes of the second wire rods 564*a* and 564*b* and the third wire rods 566*a* and 566*b* are the same as the cross-sectional shape illustrated in FIG. 7A. The first wire rods 562*a* and 562*b* are arranged between the shaft portion 561*b* and the first screw portion 563. The second wire rods 564*a* and 564*b* are arranged between the shaft portion 561*c* and the second screw portion 565. The third wire rods 566*a* and 566*b* are arranged between the shaft portions 561*a* and 561*b*. The fourth wire rods 567*a* and 567*b* are arranged between the shaft portions 561*a* and 561*c*. The arrangement direction (X-axis direction) of the first wire rods 562*a* and 562*b* and the fourth wire rods 567*a* and 567*b* is perpendicular to the arrangement direction (Y-axis direction) of the second wire rods 564*a* and 564*b* and the third wire rods 566*a* and 566*b*. With the above-mentioned structure and configuration, it is possible to suppress the torsional vibration of the shaft portion 561, and to reduce the weight of the coupling member 56. There are no particular limitations imposed on the length of each of the shaft portions 561*a*, 561*b*, and 561*c* in the Z-axis direction, but it is preferred that the shaft portion 561*a* arranged at the center be the longest. With the above-mentioned structure and configuration, the shaft portion 561 is divided into three (shaft portions 561*a*, 561*b*, and 561*c*), but the number of divisions of the shaft portion 561 is not limited thereto, and may be two or at least four.

Figure 9:
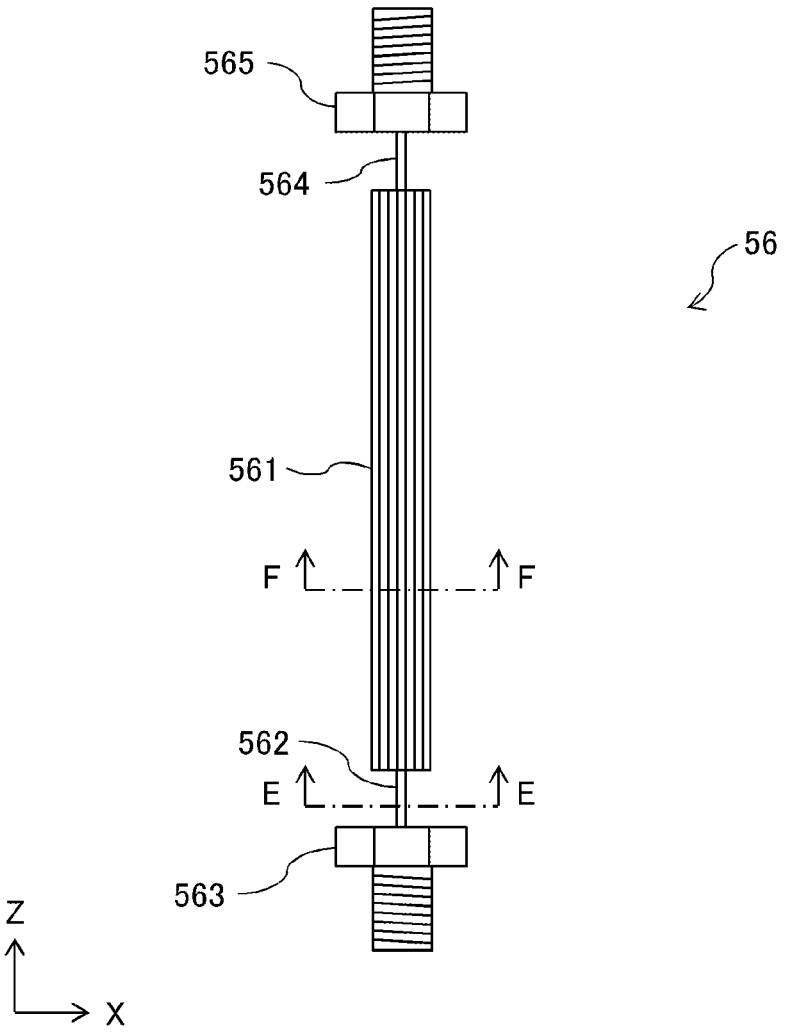
FIG. 9 is a side view for illustrating a coupling member in Modification Example 3 according to one embodiment of the present disclosure.
Figure 10A:
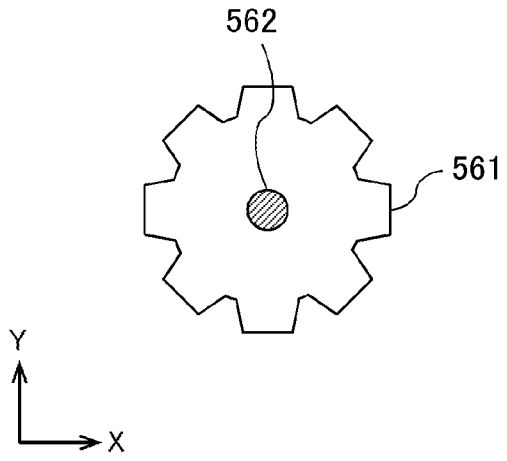
FIG. 10A is a cross-sectional view taken along the line E-E in FIG. 9.
Figure 10B:
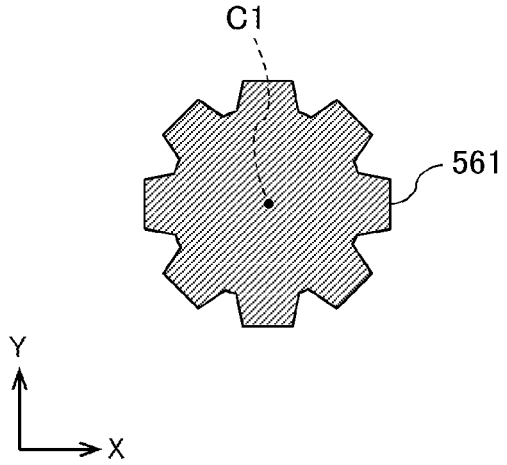
FIG. 10B is a cross-sectional view taken along the line F-F of FIG. 9.

FIG. 9 is a side view for illustrating a structure of the coupling member 56 in Modification Example 3. FIG. 10A is a cross-sectional view taken along the line E-E in FIG. 9, and FIG. 10B is a cross-sectional view taken along the line F-F in FIG. 9. The coupling member 56 in Modification Example 3 is different from the coupling member 56 illustrated in FIG. 4 in that the shaft portion 561 has a cross-sectional shape formed in a non-circular shape (for example, a polygonal shape), for example, a gear shape. With the above-mentioned structure, the weight of the outer peripheral portion far from the axis C1 of the shaft portion 561 illustrated in FIG. 10B can be reduced, and hence it is possible to suppress the torsional vibration of the shaft portion 561 and to increase the frequency due to the torsional vibration (for example, to a high frequency outside the audible range). The cross-sectional shape of the shaft portion 561 is not limited to the gear shape, and may be, for example, a triangular shape, a cross shape, or a star shape. The shaft portion 561 illustrated in Modification Example 3 may also be applied to Modification Examples 1 and 2.

Figure 11A:
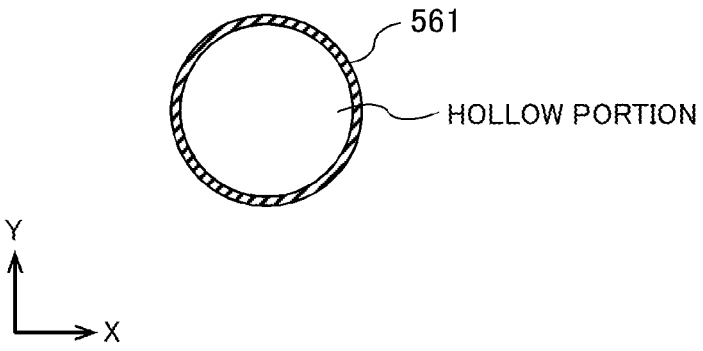
FIG. 11A and FIG. 11B are each a cross-sectional view for illustrating a cross-sectional shape of a shaft portion of the coupling member according to the one embodiment.
Figure 11B:
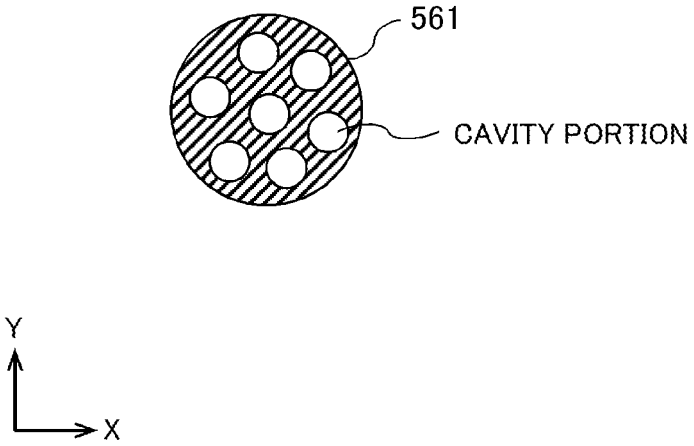

Each shaft 561 described above may have a hollow structure in its inside as illustrated in FIG. 11A, or may have a cavity structure in its inside as illustrated in FIG. 11B. With the structures illustrated in FIG. 11A and FIG. 11B, it is possible to improve the bending rigidity. In addition, the first wire rod 562 and the second wire rod 564 may be formed of one wire rod, and the one wire rod is fixed while passing through the inside of the shaft portion 561.

The vibrator 50 may be mounted so that a tensile stress acts on the coupling member 56 under a state (initial state) in which the vibrator 50 is connected to the support portion 55 illustrated in FIG. 4 and the soundboard 7 and a state in which the vibrator 50 stops operating (vibrating). This makes it easy for the first wire rod 562 and the second wire rod 564 to absorb the dimensional change and deformation of the soundboard 7.

In the above-mentioned embodiment and each of the above-mentioned modification examples, the vibrated body is exemplified by the soundboard 7, but the present invention is not limited thereto, and is also preferred to be applied to a case in which a roof, a side plate, or another such member that causes dimensional change is used as the vibrated body. Even when the vibrated body is a member that causes no dimensional change, the present invention is useful in a case in which the vibrated body is relatively displaced when dimensional change or deformation is caused in the member configured to support the vibrator in a direction that is different from (that intersects with) the vibration direction.

In addition, the piano is illustrated as a subject to which the musical instrument according to at least one embodiment of the present invention is applied, and may be any one of a grand piano and an upright piano. Further, the present invention is not limited to the piano, and may be applied to each kind of acoustic musical instrument including a vibrator, an electronic musical instrument including a vibrator, a stringed musical instrument including a vibrating body, or a speaker. In those cases, any musical instrument or any speaker that includes a vibrated body that can be forced to vibrate may be employed.

What is claimed is:

1. A musical instrument comprising:

a vibratable body; and a vibrator comprising:

a vibrating body that vibrates in a predetermined direction; and a coupling member coupling the vibrating body and the vibratable body and that transmits vibration of the vibrating body to the vibratable body, the coupling member including:

a shaft extending between the vibrating body and the vibratable body;

a first wire rod coupling one end portion of the shaft and the vibrating body; and a second wire rod coupling another end portion of the shaft and the vibratable body, wherein a resonance frequency of each of the shaft, the first wire rod, and the second wire rod is at least 10 kHz.

2. The musical instrument according to claim 1, wherein the resonance frequency is higher than an audible frequency range.

3. The musical instrument according to claim 1, wherein each of the first wire rod and the second wire rod is a steel wire containing a predetermined amount of carbon.

4. The musical instrument according to claim 1, wherein each of the first wire rod and the second wire rod is made of a steel wire including a carbon content of 0.60% to 1.00%.

5. The musical instrument according to claim 1, further comprising:

a damper supporting the vibrating body to allow the vibrating body to be displaced in the predetermined direction; and a magnetic assembly that forms a magnetic path, wherein the damper is fixed to the magnetic assembly, and wherein each of the first wire rod and the second wire rod is lower in rigidity than the damper.

6. The musical instrument according to claim 1, wherein:

the first wire rod comprises two first wire rods arranged side by side in a first direction, the second wire rod comprises two second wire rods arranged side by side in a second direction, and the first direction and the second direction are perpendicular to each other.

7. The musical instrument according to claim 1, wherein:

the shaft comprises a plurality of shaft portions spaced along the predetermined direction, and two adjacent shaft portions of the shaft portion are coupled to each other with another wire rod having the same structure and configuration as the first wire rod and the second wire rod.

8. The musical instrument according to claim 1, wherein a cross-sectional shape of the shaft is polygonal.

9. The musical instrument according to claim 1, wherein the coupling member is fixed to the vibrating body so that a tensile stress acts on the coupling member in a direction in which the shaft extends while the vibrator stops operating.

10. A musical instrument comprising:

a vibratable body; and a vibrator comprising:

a vibrating body provided so as to vibrate in the predetermined direction; and a coupling member coupling the vibrating body and the vibratable body, and that transmits vibration of the vibrating body to the vibratable body, the coupling member including:

a shaft extending between the vibrating body and the vibratable body;

a first wire rod coupling one end portion of the shaft and the vibrating body; and a second wire rod coupling another end portion of the shaft and the vibratable body, wherein each of the first wire rod and the second wire rod is made of a steel wire including a carbon content of 0.60% to 1.00%, and wherein the shaft is made of a metal material with a higher specific rigidity than specific rigidities of the first wire rod and the second wire rod.

11. The musical instrument according to claim 10, wherein a resonance frequency of each of the shaft, the first wire rod, and the second wire rod is at least 10 kHz.

12. A vibrator for a musical instrument including a vibratable body, the vibrator comprising:

a vibrating body that vibrates in a predetermined direction; and a coupling member coupling the vibrating body and configured to be coupled to the vibratable body to transmit vibration of the vibrating body to the vibratable body, the coupling member including:

a shaft configured to extend between the vibrating body and the vibratable body;

a first wire rod coupling one end portion of the shaft and the vibrating body; and a second wire rod coupled to another end portion of the shaft and configured to be coupled to the vibratable body, wherein a resonance frequency of each of the shaft, the first wire rod, and the second wire rod is at least 10 kHz.

13. The vibrator according to claim 12, wherein the resonance frequency is higher than an audible frequency range.

14. The vibrator according to claim 12, wherein each of the first wire rod and the second wire rod is made of a steel wire including a carbon content of 0.60% to 1.00%.

15. The vibrator according to claim 12, wherein the shaft is made of a metal material with a higher specific rigidity than specific rigidities of the first wire rod and the second wire rod.

16. The vibrator according to claim 14, wherein the shaft is made of a metal material with a higher specific rigidity than specific rigidities of the first wire rod and the second wire rod.

* * * * *